US006990879B2

(12) United States Patent
Rubino

(10) Patent No.: US 6,990,879 B2
(45) Date of Patent: Jan. 31, 2006

(54) DRAIN LINE RE-PERFORATOR DEVICE

(76) Inventor: Daniel L. Rubino, 11351 W. 193rd St., Mokena, IL (US) 60448

( * ) Notice: Subject to any disclaimer, the term of this patent is extended or adjusted under 35 U.S.C. 154(b) by 166 days.

(21) Appl. No.: 10/746,649

(22) Filed: Dec. 29, 2003

(65) Prior Publication Data

US 2005/0145079 A1 Jul. 7, 2005

(51) Int. Cl.
*B26D 3/00* (2006.01)
*B26D 5/12* (2006.01)
*E21B 37/00* (2006.01)

(52) U.S. Cl. ..... 83/54; 83/185; 83/191; 83/607; 83/639.1; 166/55.2; 138/97

(58) Field of Classification Search ..... 83/54, 83/184, 185, 187, 191, 867, 866, 639.1, 607; 166/55.2, 55; 138/97; 264/155; 405/184.3
See application file for complete search history.

(56) References Cited

U.S. PATENT DOCUMENTS 1,432,073 A * 10/1922 Lowy ..... 72/325
1,502,097 A * 7/1924 Grace ..... 83/184
2,279,211 A * 4/1942 Thomas ..... 83/185
3,259,003 A * 7/1966 Griffin ..... 83/54
3,950,461 A * 4/1976 Levens ..... 264/46.5
3,957,386 A * 5/1976 Lupke ..... 408/50
4,197,908 A * 4/1980 Davis et al. ..... 166/55
4,205,697 A * 6/1980 Gebelius ..... 137/15.01
4,254,075 A * 3/1981 Menzel et al. ..... 264/154
4,270,878 A * 6/1981 Fales ..... 409/143
4,434,815 A * 3/1984 Flaherty et al. ..... 138/97
4,442,891 A * 4/1984 Wood ..... 166/55.2
4,577,388 A * 3/1986 Wood ..... 29/558
4,971,146 A * 11/1990 Terrell ..... 166/55
5,167,279 A * 12/1992 Stafford ..... 166/171
5,701,958 A * 12/1997 Braziel ..... 166/298
5,799,729 A * 9/1998 Breckwoldt et al. ..... 166/55
5,924,489 A * 7/1999 Hatcher ..... 166/298
5,953,974 A * 9/1999 Hegler et al. ..... 83/206
5,960,894 A * 10/1999 Lilly et al. ..... 175/4.6
6,295,909 B1 * 10/2001 Schofield et al. ..... 83/285
6,386,797 B1 * 5/2002 Gearhart ..... 405/184.3
6,484,551 B1 * 11/2002 Hagg et al. ..... 72/370.27
6,553,883 B1 * 4/2003 Adami ..... 83/508.1
6,637,508 B2 * 10/2003 Marsh et al. ..... 166/55.2

* cited by examiner

*Primary Examiner*—Charles Goodman
(74) *Attorney, Agent, or Firm*—Davis Chin

(57) ABSTRACT

A drain line re-perforator device for punching holes in clogged drain pipe sections in a sewage disposal system is provided. The re-perforator device includes an outer cylindrically-shaped housing member and a dual-actuating ram assembly disposed concentrically within the outer housing member. Three equally spaced-apart angled bracket members are mounted hingedly on the peripheral surface of the outer housing member and includes a punch bit positioned for outward radial movement. The ram assembly is formed of a cylinder and a piston rod. The piston rod is moved in a reciprocal motion from a retracted position to a an extended position so as to cause the angled bracket members to pivot outwardly and the punch bits to move outward radially for punching holes in the clogged drain pipe sections.

18 Claims, 5 Drawing Sheets

DRAIN LINE RE-PERFORATOR DEVICE

BACKGROUND OF THE INVENTION

1. Field of the Invention

This invention relates generally to sewage disposal systems used in residential and commercial environments. More particularly, the present invention relates to a drain line re-perforator device for punching holes in clogged drain pipe sections in a sewage disposal system. Specifically, the drain line re-perforator device of the instant invention includes an outer cylindrically-shaped housing member, a dual-actuating ram assembly disposed concentrically within the outer housing member, and a plurality of angled bracket members mounted hingedly on the peripheral surface of the outer housing member so as to move outward radially punch bits for perforating drain pipe sections in a sewage disposal system.

2. Description of the Prior Art

As is generally known in the past, it has been typical to provide sewage disposal systems for individual homes, commercial buildings, and the like located outside of areas serviced by community sewage treatment systems. As illustrated in FIG. 1, there is shown a conventional sewage disposal system 100 which includes a septic tank 10 and a drain field defined by a plurality of interconnected flexible corrugated drain pipe sections 12, formed usually by horizontally extending perforated conduits or tubes. The septic tank 10 has its inlet port 14 connected to a sewer line 16 extending from a house or building (not shown) and has its outlet port 18 coupled to a distribution box or header pipe section 20 via an interconnecting pipe section 22. The header pipe section 20 has an inlet junction 24 for connection to the interconnecting pipe section 22 and a plurality of concrete or fiberglass junction boxes 26 for connection to corresponding ones of the corrugated drain pipe sections 12.

The septic tank 10 includes normally entrapment of floating solids and settling of other solids which are degraded in the septic tank by micro-organisms. The effluent having a substantial portion of the solids removed is then fed from the outlet port 18 of the septic tank 10 through the interconnecting pipe section 22 to the header pipe section 20 which distributes the effluent to flow through the plurality of corrugated drain pipe sections 12. The corrugated drain pipe sections 12 are disposed within a drainage trench and surrounded by a quantity of loose aggregate material 28, such as rock, gravel, or crushed stone and covered with compacted soil 29. The corrugated drain pipe sections 12 are further formed with a number of holes or perforations so that the effluent being carried can be easily drained therefrom and percolate into the soil 29. The space between the corrugated drain pipe sections 12 and the ground occupied by the aggregate material 28 serves to provide a draining cavity in fluid communication with the perforations in the corrugated drain pipe sections 12.

While the aggregate material 28 generally prevents the blockage of the pipe perforations, it has been encountered that after many years of using the sewage disposal system the perforations in one or more of the pipe sections 12 can become clogged or damaged and thus render the system inoperable. This clogging or damage may be the result of many causes, such as soil movements, deterioration of the aggregate material, blockage of the holes in the pipe sections, and the like. The conventional method of repairing the clogged or damaged pipe sections requires expensive and labor-intensive excavation, removal of the damaged pipe sections, and installation of new pipe sections. The disadvantage of this prior art method is apparent when it is considered that the pipe sections are quite numerous extending up to a hundred feet or so and are buried commonly several feet underneath the backyard of the individual home. Therefore, substantial expense can be involved in subterranean digging and repair under such conditions. In addition, this prior art method can require a long period of time and during this time, use of the sewage disposal system is unavailable as well as the backyard of the home.

Accordingly, it would be desirable to provide a method and apparatus for unclogging drain pipe sections in a sewage disposal system which is relatively simple and inexpensive in design, construction, and operation. It would also be expedient that the apparatus for unclogging the drain pipe sections be operable easily and safely by an unskilled workman such as a homeowner or the like.

A prior art search directed to the subject matter of this application in the U.S. Patent and Trademark Office revealed the following Letters Patent and application:

| |
|---|
| 3,950,461 |
| 4,197,908 |
| 4,254,075 |
| 4,434,815 |
| 5,167,279 |
| 5,960,894 |
| 6,386,797 |

In U.S. Pat. No. 5,960,894 to Terry G. Lilly et al. issued on Oct. 5, 1999, there is disclosed an expendable tube conveyed perforator system for perforating well casings which includes an outer tube and inner tubular structure disposed parallel to the longitudinal axis of the outer tube. The inner structure is provided with holes for accommodating a plurality of shaped explosive charges connected together by primer cords. The expendable tubing conveyed perforator may be combined in sections to produce a longer perforator unit. In use, the expendable tubing conveyed perforator is lowered into the casing well to the desired depth and is then detonated.

In U.S. Pat. No. 6,386,797 to Stephen V. Gearhart issued on May 14, 2002, there is taught a mobile cutting system for cutting lateral openings in rehabilitative sewer pipe liners which includes a sled having a cylindrical body and runners. An extension arm is extendable and retractable in a direction parallel to a longitudinal axis of the body. A cutting head is attached to the extendable arm which is rotatable relative to the cutting head. Also, the arm may be rotated relative to the body. A solenoid valve disposed within the body of the sled is used to supply ultra-high pressure fluid to the cutting head. After the sled is placed in the vicinity of the lateral connection in which an opening is to be cut, the extension and rotation may be performed by an electric motor so as to bring the cutting head into the specific location of cutting.

In U.S. Pat. No. 5,167,279 to Lawrence R. Stafford issued on Dec. 1, 1992, there is taught a well casing cleaning assembly comprising a tubular mandrel provided with a plurality of longitudinal slots formed on its peripheral surface. The slots are distributed at substantially equal arc increments in a peripheral strip around the mandrel in which replaceable knife carriers are inserted. A longitudinal opening extends through the pivot carrier into the bore in which a knife blade is received. A pivot pin then engages the blade to the pivot carrier for allowing pivotal motion of the blade.

In U.S. Pat. No. 3,950,461 to Joseph A. Levens issued on Apr. 13, 1976, there is disclosed a method and apparatus for repairing a buried main having connected lateral service conduits which consists of a flexible assembly having an elongated flexible conduit with a seal mounted near an end for insertion into a conduit. The external end of the conduit is connected a cylinder joined to a source of pressurized gas via second conduit. A valve is provided to regulate the flow of pressurized gas into the cylinder. A cutter assembly is attachable to the end adjacent the seal and includes a cutting head with a leading bit.

The remaining patents, listed above but not specifically discussed, are deemed to be only of general interest and show the state of the art in perforator methods and apparatuses for perforating various types of well casings, conduits, or liners which includes a cutting tool.

None of the prior art discussed above disclosed a drain line re-perforator device that of the present invention which includes an outer cylindrically-shaped housing member, a dual-actuating ram assembly disposed concentrically within the outer housing member, and a plurality of angled bracket members mounted hingedly on the peripheral surface of the outer housing member so as to move outward radially punch bits for perforating drain pipe sections in a sewage disposal system.

SUMMARY OF THE INVENTION

Accordingly, it is a general object of the present invention to provide a drain line re-perforator device for punching holes in clogged drain pipe sections in a sewage disposal system which is relatively simple and inexpensive in design, construction and operation.

It is an object of the present invention to provide a drain line re-perforator device for punching holes in clogged drain pipe sections in a sewage disposal system on an efficient and cost effective basis.

It is another object of the present invention to provide a drain line re-perforator device for punching holes in clogged drain pipe sections in a sewage disposal system which can be operated easily and safely by an unskilled workman.

It is still another object of the present invention to provide a drain line re-perforator device for punching holes in clogged drain pipe sections in a sewage disposal system which includes an outer cylindrically-shaped housing member, a dual-actuating ram assembly disposed concentrically within the outer housing member, and a plurality of angled bracket members mounted hingedly on the peripheral surface of the outer housing member so as to move outward radially punch bits for perforating drain pipe sections in a sewage disposal system.

In a preferred embodiment of the present invention, there is provided a drain line re-perforator device for punching holes in clogged drain pipe sections in a sewage disposal system. The re-perforator device includes an outer cylindrically-shaped housing member and a dual-actuating ram assembly disposed concentrically within the outer housing member. Three equally spaced-apart angled bracket members are mounted hingedly on the peripheral surface of the outer housing member and include a punch bit positioned for outward radial movement. The ram assembly is formed of a cylinder and a piston rod. The piston rod is moved in a reciprocal motion from a retracted position to a an extended position so as to cause the angled bracket members to pivot outwardly and the punch bits to move outward radially for punching holes in the clogged drain pipe sections.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
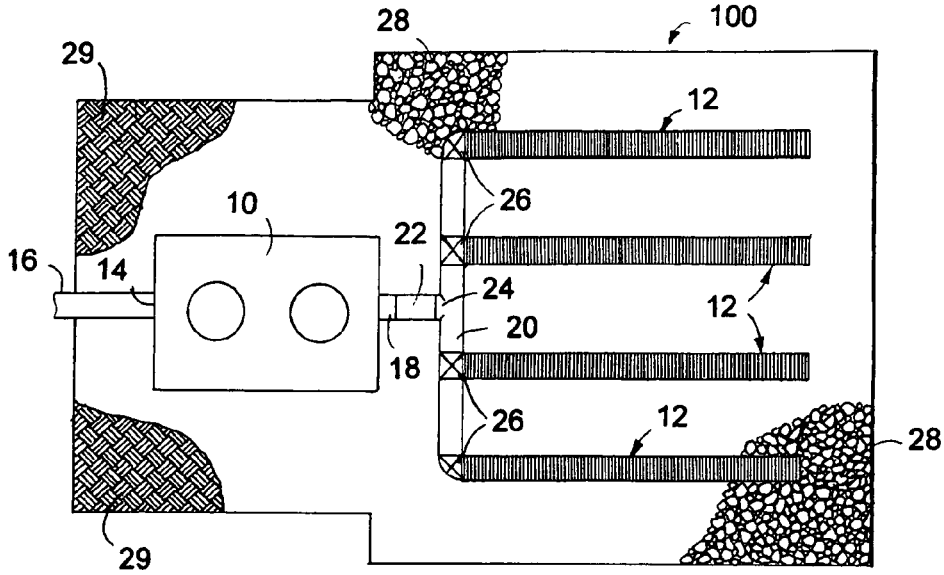
FIG. 1 PRIOR ART
FIG. 1 is a partial top view of a conventional sewage disposal system buried under a backyard, illustrating the relationship of a septic tank and a plurality of drain pipe sections.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Referring now in detail to the drawings, there is illustrated in FIG. 1 a partial top plan view of a conventional sewage disposal system 100, such as would be buried under a backyard of an individual home located outside of areas serviced by community sewage treatment systems. As earlier described in the background of this specification, the sewage disposal system 100 includes the septic tank 10 and a drain field defined by a plurality of interconnected flexible corrugated drain pipe sections 12 extending from the distribution box or header pipe section 20. The header pipe section 20 is connected to the outlet port 18 of the septic tank 10 by way of the interconnecting pipe section 22. The inlet port 14 of the septic tank 10 is joined to the sewer line 16 extending from the building or individual home.

Figure 2:
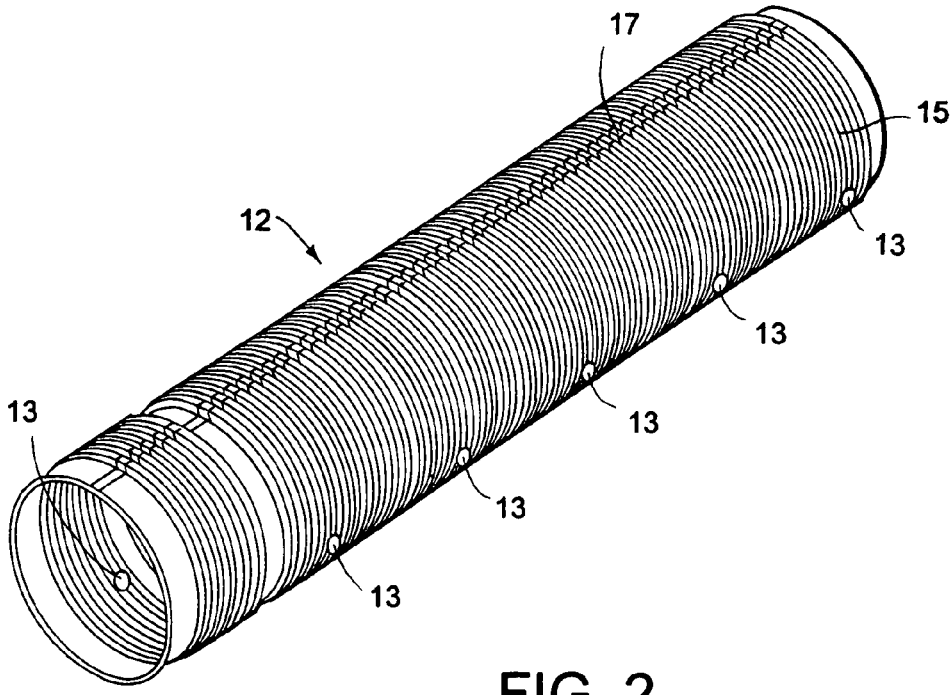
FIG. 2 PRIOR ART
FIG. 2 is an enlarged perspective view of a portion of one of the plurality of drain pipe sections of FIG. 1.
Figure 3:
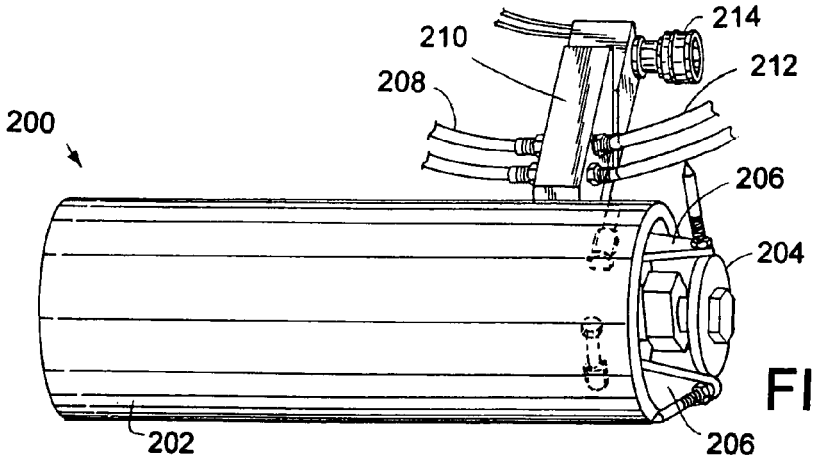
FIG. 3 is a perspective view of a drain line re-perforator device, constructed in accordance with the principles of the present invention.

As previously pointed out, the plurality of corrugated drain pipe sections are generally formed with holes or perforations therein so that the effluent can seep from the pipe sections. As is shown in FIG. 2, there is depicted an enlarged perspective view of a small portion of one of the plurality of corrugated drain pipe sections which is formed with holes or perforations 13 located along its side portions 15. Each of the pipe sections has typically an inside diameter of approximately four inches and an outer diameter including the corrugations 17 of approximately four and three quarters inches.

The corrugated drain pipe sections 12 are further buried within drainage trenches and surrounded by the aggregate material 28 so that the effluent can easily drain from the pipe sections. Although the buried corrugated drain pipe sections operate quite satisfactory for this purpose, it has been experienced that over a period of time the drain pipe section can be rendered inoperative due to the perforations thereof becoming clogged or damaged. As a consequence, the drain pipe sections must be dug up and replaced which involves expensive labor-cost.

In order to overcome this problem associated with the drain pipe sections in the sewage disposal system of FIG. 1, the inventor of the present invention has developed a drain line re-perforator device for punching holes in clogged drain pipe sections in a sewage disposal system. As a result, the sewage disposal system can be repaired and made operational again on an efficient and thus cost effective basis.

With reference now to FIGS. 3 through 7 of the drawings, there is depicted a perspective view of a drain line re-perforator device 200, constructed in accordance with the principles of the present invention. Although it is anticipated that many alternate uses of present invention will be employed, it is envisioned that preferred embodiment herein described has particular application for punching holes in clogged drain pipe sections 12 in the sewage disposal system 100 of FIG. 1. The drain line re-perforator device 200 for punching holes in clogged drain pipe sections in sewage disposal system is comprised of an outer cylindrical-shaped housing member 202, a dual-actuating pneumatic ram assembly 204 disposed concentrically within the outer housing member, and a plurality (three) of spaced-apart angled bracket members 206 mounted hingedly on the peripheral surface of the housing member.

An air hose 208 is used to supply air to the ram assembly 204 from the outlet of an air manifold 210. The air manifold 210 has its inlet connected to an air compressor (not shown) via inlet line 212. A source of air is connectable to the air compressor. The air manifold 210 regulates the amount of compressed air flowing to the ram assembly 204, which is in the range of 100 to 120 p.s.i. and is operated preferable at about 100 p.s.i. A push-button switch 214 is connected to the source of air for turning on and off the same.

Figure 6:
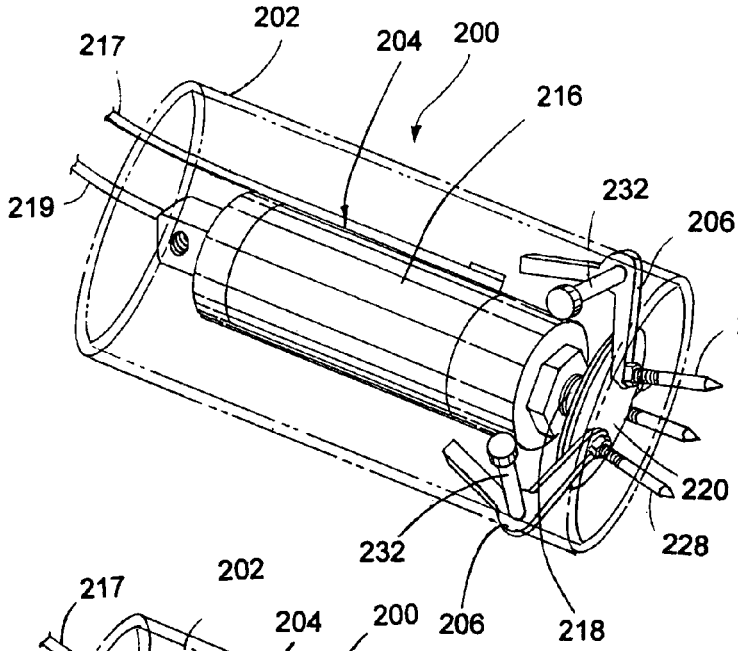
FIG. 6 is a perspective view of the dual-actuating ram and two of the angled rotatable members, illustrating the piston rod in the retracted position.
Figure 7:
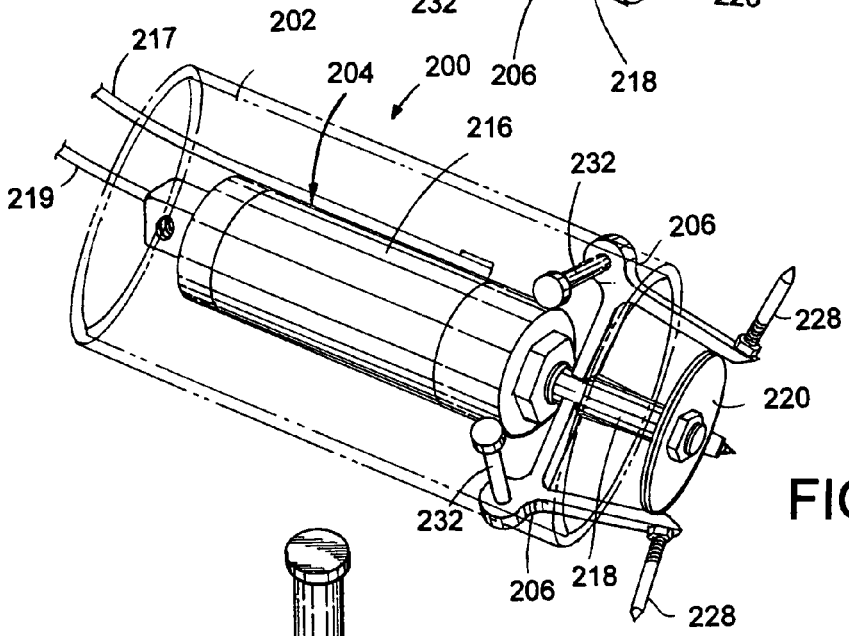
FIG. 7 is a perspective view similar to FIG. 6, but illustrating the piston rod in the extended position.
Figure 8:
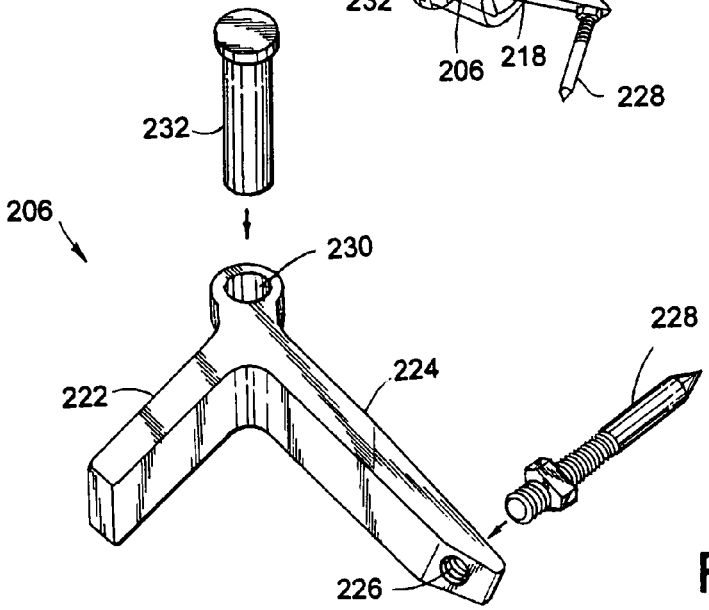
FIG. 8 is a detailed view of one of the angled rotatable members of FIG. 7, illustrating the separate parts thereof.

As can be best seen from FIGS. 6 through 8, the dual-actuating pneumatic ram assembly 204 includes a pneumatic cylinder 216 and a piston rod 218. An annular plate or disc 220 is mounted vertically and concentrically on the distal end of the piston rod 218 for reciprocal movement along the longitudinal axis of the cylinder 216. The piston rod 218 drives the disc 220 in reciprocal motion in response to the control of air flowing in the air hose 208 into the cylinder 216. Each of the angled bracket members 206 is of a generally L-shaped configuration having a shorter leg portion 222 and a longer leg portion 224. The angled bracket members 206 are located 120 degrees apart from each other. At the distal end of the longer leg portions 224, there is provided a threaded opening 226 therein for receiving a threaded punch bit 228 which positioned for outward radial movement. At the junction of the shorter and longer leg portions, there is provided an annular mounting portion 230 for receiving hingedly a pivot pin 232.

Figure 9:
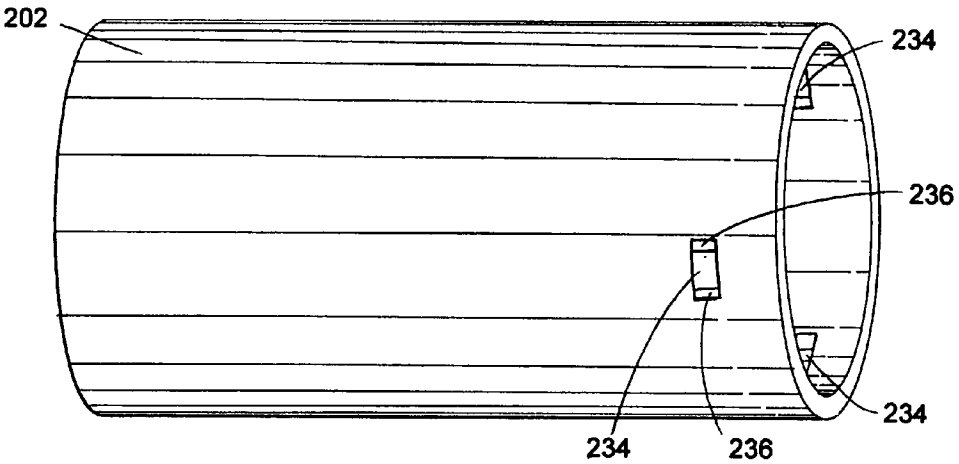
FIG. 9 is a perspective view of the outer cylindrical member of the re-perforator device.

In FIG. 9, there is shown a perspective view of the outer cylindrical-shaped housing member 202 which has an inner diameter of approximately three inches and is approximately eight and one-half inches in length. The housing member is made from a metallic material. Preferably, the housing member is fabricated from steel, stainless steel, or the like. At adjacent to the top end thereof, there are provided three rectangularly-shaped slots 234 which equally spaced apart at 120 degrees around the circumference of the housing member 202. On the opposed sides of each of the slots 234, there are formed recessed support sections 236. Each of the slots 234 is used to receive therein a corresponding one of the annular mounting portions 230 of the angled bracket members 206. Each of the pivot pins 232 is inserted through the respective one of the annular mounting portions 230 so that their ends thereof come to rest against the opposed recessed support sections 236. In this manner, the angled bracket members are mounted hingedly or pivotally on the peripheral surface of the housing member.

Figure 4:
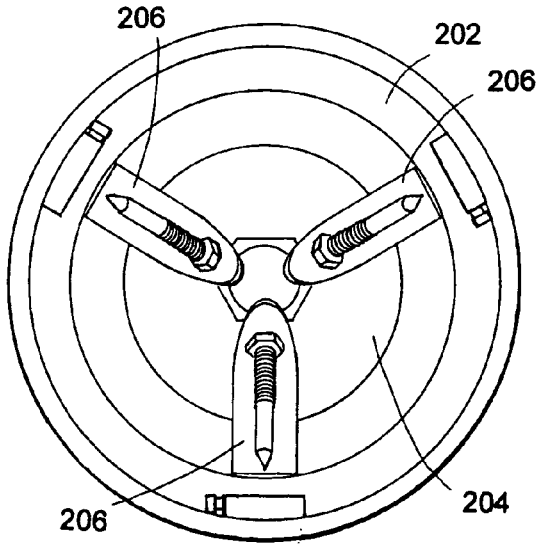
FIG. 4 is an end view of the drain line re-perforator device, illustrating the piston rod in the retracted position.
Figure 5:
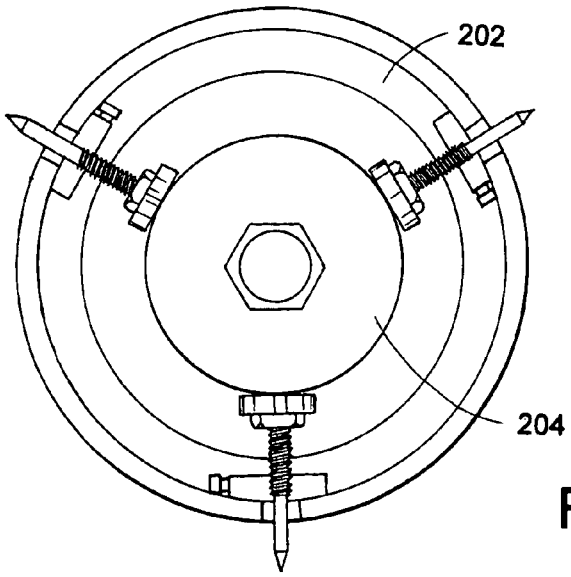
FIG. 5 is an end view similar to FIG. 4, but illustrating the piston rod in the extended position.

In operation, the drain line re-perforator device 200 is inserted and pushed down the clogged drain pipe sections 12 (FIG. 2) until the end thereof is reached. As will be noted, prior to using of the re-perforator device the soil surrounding the junction box 26 must be dug up in order to gain access to the drain pipe sections 12. Then, the re-perforator device is pulled back and stopped every so often (i.e., approximately every three inches or so) and the switch 214 is depressed so as to drive the piston rod 218 and the disc 220 in reciprocal motion in response to the air flowing through the air hose 208 coupled to the air compressor. This process is repeated over and over again until the entire length of the clogged drain pipe section 12 has been re-perforated. As a result, the piston rod and the disc are moved reciprocally along the longitudinal axis of the pneumatic cylinder 216 from its retracted or closed position (as shown in FIGS. 4 and 6) to its extended or open position (as shown in FIGS. 5 and 7.

It will be understood by those skilled in the art that the flexible air pipes 217 and 219 are operatively connected to the front and rear compartments respectively of the pneumatic cylinder 216, as illustrated in FIGS. 6 and 7. When one of the air pipes 217,219 delivers air under pressure to one of the cylinder compartments, the other one of the air pipes drains air from the other compartments. In this fashion, the end of the piston rod disposed inside of the cylinder is permitted to move reciprocally therein.

When the piston rod 218 and the disc 220 are moved to their extended position, this will in turn cause the three angled bracket members 206 to pivot outwardly and the corresponding punch bits 228 to move outward radially for punching three new holes in the side portions of the drain pipe sections 12. This is due to the engagement of the disc with the longer leg portions 224 of the angled bracket members 206 so as to force them to rotate or pivot outwardly about the pivot pin 232. As a consequence, the newly formed holes or perforations will allow the effluent to drain out therefrom so as to unclog the clogged drain pipe sections 12, thereby permitting the "dead" sewage disposal system to be re-used again so as to extend its useful life.

When the piston rod 218 and the disc 220 are back moved to their retracted position, this will in turn cause the three angled bracket members 206 to pivot inwardly and the corresponding punch bits 228 to move inward radially to the center of the housing member 202. This is due to the engagement of the disc with the shorter leg portions 222 of the angled bracket members 206 so as to force them to rotate or pivot inwardly about the pivot pin 232.

Figure 10:
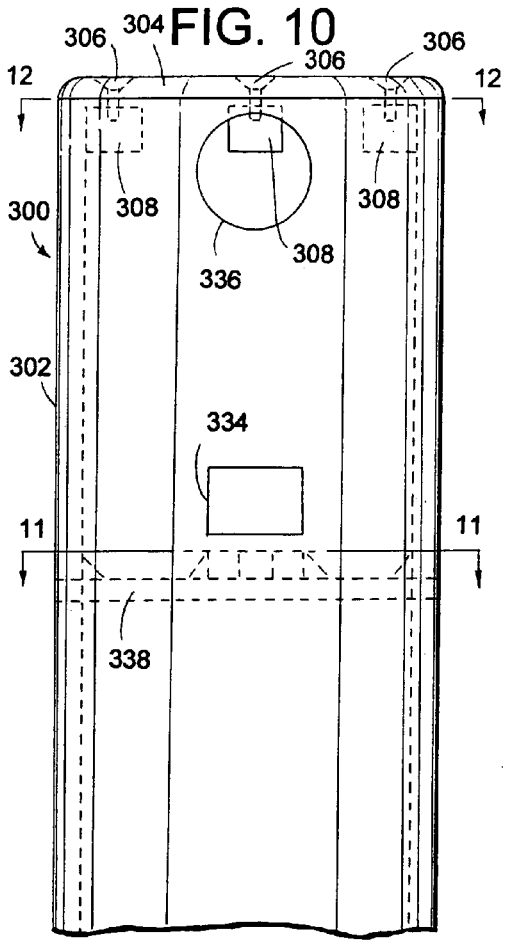
FIG. 10 is a top plan view of a second embodiment of a drain line re-perforator device in accordance with the present invention.
Figure 11:
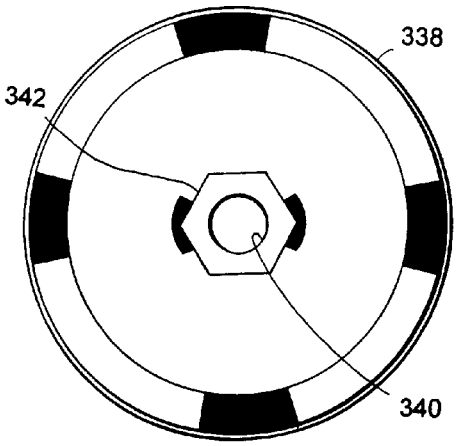
FIG. 11 is a cross-sectional view, taken along the lines 11—11 of FIG. 10.
Figure 12:
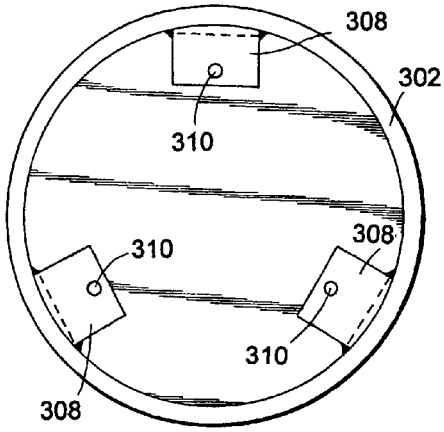
FIG. 12 is a cross-sectional view, taken along the lines 12—12 of FIG. 10.
Figure 13:
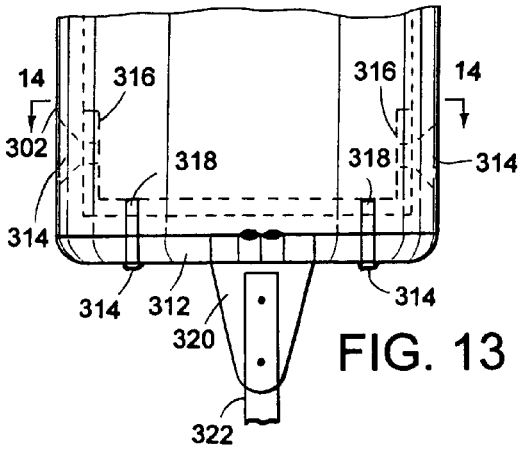
FIG. 13 is a partial view of the lower end of the re-perforator device of FIG. 10.
Figure 14:
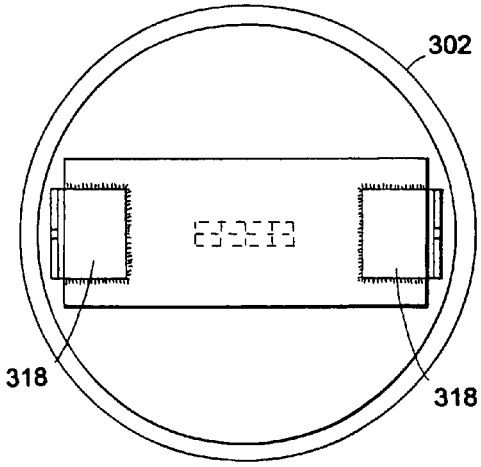
FIG. 14 is a cross-sectional view, taken along the lines 14—14 of FIG. 13.

In FIGS. 10 through 16, there is shown a second embodiment of a drain line re-perforator device 300 of the present invention. FIG. 10 is a top plan view of the outer cylindrically-shaped housing member 302 of the re-perforator device 300. FIG. 11 is a cross-sectional view taken along the lines 11—11 of FIG. 10. FIG. 12 is a cross-sectional view taken along the lines 12—12 of FIG. 10. FIG. 13 is a partial view of the lower end of the housing member 302. FIG. 14 is a cross-sectional view taken along the lines 14—14 of FIG. 13.

A front end cap 304 (FIG. 10) is secured to the top end of the housing member 302 by flat head screws 306. The end cap 304 is used to facilitate the sliding of the re-perforator device 302 into the clogged drain pipe sections 12 (FIG. 2). Three L-shaped support brackets 308 (FIG. 12) are fixedly secured, such as by welding, adjacent to the top end of the housing member 302 on its interior surface at 120 degrees apart. The brackets 308 are provided with threaded openings 310 for receiving the screws 306 for mounting the end cap 304 to the top end of the housing member 302.

Similarly, a rear end cap 312 (FIG. 13) is secured to the bottom end of the housing member 302 by flat head screws 314. The end cap 312 is used to facilitate the sliding of the re-perforator device 302 out of the clogged drain pipe sections 12 (FIG. 2). Three L-shaped support brackets 316 (FIG. 14) are fixedly secured, such as by welding, adjacent to the bottom end of the housing member 302 on its interior surface at 120 degrees apart. The brackets 316 are provided with threaded openings 318 for receiving the screws 314 for mounting the end cap 312 to the bottom end of the housing member 302. Further, the central portion of the rear end cap 312 is provided with a hinged portion 320 which is fixedly secured thereto by welding and the like. The hinged portion 320 is used to receive a rodder 322 which may be bolted thereto. The rodder 322 serves to facilitate the easy pushing of the re-perforator device 300 down the clogged drain sections 12.

The re-perforator device 300 (FIG. 10) further includes three rectangularly-shaped slots 334 which are equally spaced apart at 120 degrees around the circumference of the housing member 302. Each of the slots 334 is used to receive therein a corresponding one of the annular mounting portions of the angled bracket members 206 (FIG. 8). The re-perforator device 300 has also formed at adjacent its top end three aligned circular openings 336 which are equally spaced apart at 120 degrees around its circumference. Each of the aligned openings is used to allow a corresponding one of the punch bits of the angled bracket members 206 to extend therethrough when the piston is moved to the extended position.

Figure 15:
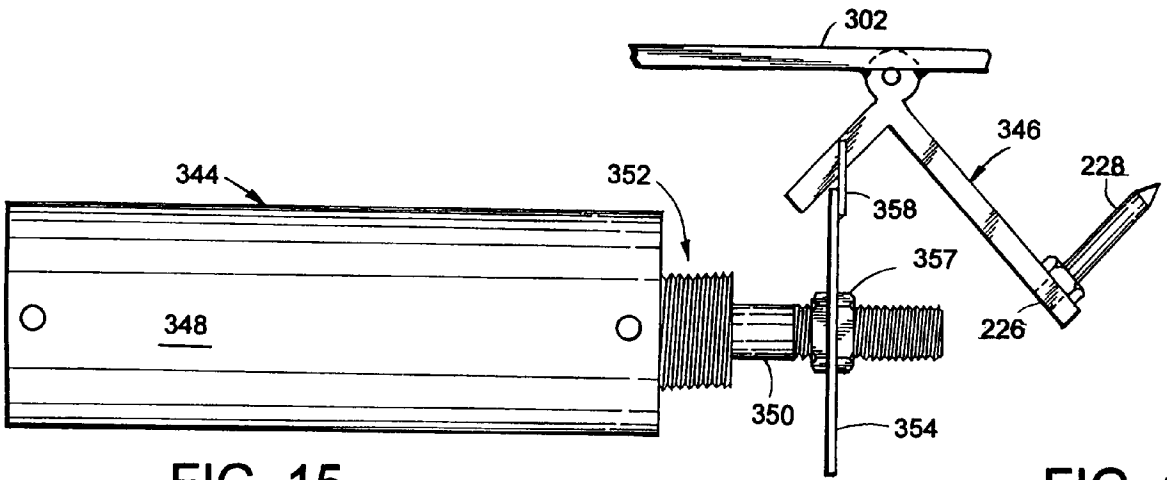
FIG. 15 is a functional view of the re-perforator device of FIG. 10 for operation with an angled bracket member.

In FIG. 11, there is shown a round plate 338 which is fixedly secured, such as by welding, to the inside peripheral surface of the housing member 302. The round plate 338 has a central aperture 340 in which a nut 342 is welded around. In FIG. 15, there is shown a functional view of the re-perforator device 300 of FIG. 10 which has a ram assembly 344 for operation with an angled bracket member 346. The ram assembly 344 includes a pneumatic cylinder 348 and a piston rod 350. The pneumatic cylinder 348 includes a threaded portion 352 which is screwed through the nut 352 (FIG. 11) so as to mount the ram assembly within the housing member 302.

Figure 16:
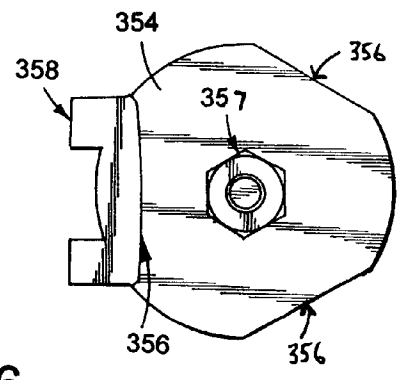
FIG. 16 is a plan view of the guide plate for use in FIG. 15.

In FIG. 16, there is depicted a guide plate 354 having three flat sections 356 which are spaced apart at 120 degrees. The guide plate is retained on the threaded piston rod 350 by a nut 357. In order to prevent the piston rod from rotating inside of the housing member, there is formed a C-shaped stop member 358 formed on one of the flat sections 356. In use, the C-shaped stop members 358 are caused to contactly engage with a corresponding one of the shorter and longer leg portions of the angled bracket members 346 as the piston rod is moved between its retracted and extended positions.

From the foregoing detailed description, it can thus be seen that the present invention provides a drain line re-perforator device which includes an outer cylindrically-shaped housing member, a dual-actuating ram assembly disposed concentrically within the outer housing member, and a plurality of angled bracket members mounted hingedly on the peripheral surface of the outer housing member so as to move outward radially punch bits for perforating drain pipe sections in a sewage disposal system. As a result, the sewage disposal system can be made operational again on an effective and efficient basis without substantial excavation and expensive labor cost.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A drain line re-perforator method for punching holes in clogged drain pipe sections in a sewage disposal system, said re-perforator method comprising the steps of:

providing a dual-actuating ram assembly formed of a cylinder and a piston rod and disposed concentrically within an outer cylindrically-shaped outer housing member;

mounting hingedly three equally spaced-apart angled bracket members on the peripheral surface of the outer housing member and including a punch bit positioned for outward radial movement;

positioning punch bits on the angled bracket members for outward radial movement;

inserting the housing member and the ram assembly into the clogged drain pipe section; and moving said piston rod in a reciprocal motion from a retracted position to a an extended position so as to cause the angled bracket members to pivot outwardly and said punch bits to move outward radially for punching holes in the clogged drain pipe sections.

2. A drain line re-perforator device for punching holes in clogged drain pipe sections in a sewage disposal system, said re-perforator device comprising:

an outer cylindrically-shaped housing member;

a dual-actuating ram assembly disposed concentrically within said outer housing member;

three equally spaced-apart angled bracket members mounted hingedly on the peripheral surface of said outer housing member and including a punch bit positioned for outward radial movement;

said ram assembly being formed of a cylinder and a piston rod; and said piston rod being moved in a reciprocal motion from a retracted position to a an extended position so as to cause said angled bracket members to pivot outwardly and said punch bits to move outward radially for punching holes in the clogged drain pipe sections.

3. A drain line re-perforator device as claimed in claim 2, wherein each of said angled bracket members is formed generally of a L-shaped configuration having a shorter leg portion, a longer leg portion, and an annular mounting portion for joining together said shorter leg portion and said longer leg portion.

4. A drain line re-perforator device as claimed in claim 3, wherein said outer housing member include three equally spaced-apart slots disposed around its circumference and adjacent its top end, said slots receiving therein a corresponding one of the annular mounting portions of the angled bracket members.

5. A drain line re-perforator device as claimed in claim 4, further comprising a pivot pin being inserted through each of said annular mounting portions for mounting pivotally each of said angled bracket members on the peripheral surface of said housing member.

6. A drain line re-perforator device as claimed in claim 2, wherein said outer housing member is made of a metallic material.

7. A drain line re-perforator device as claimed in claim 6, wherein said outer housing member is made of steel.

8. A drain line re-perforator device as claimed in claim 2, wherein said outer housing member is made of a stainless steel material.

9. A drain line re-perforator device as claimed in claim 2, further comprising a front end cap secured to the top end of said housing member and a rear end cap secured to the bottom end thereof for facilitating the sliding of the re-perforator device into and out of the clogged drain pipe sections.

10. A drain line re-perforator device as claimed in claim 9, further comprising a hinged portion secured to said rear end cap for connection to a rodder to facilitate the easy pushing of the re-perforator device down the clogged drain pipe sections.

11. A drain line re-perforator device as claimed in claim 2, wherein said ram assembly is operated pneumatically with an air pressure in the range of 100 p.s.i. to 120 p.s.i.

12. A drain line re-perforator device for punching holes in clogged drain pipe sections in a sewage disposal system, said re-perforator device comprising:

outer cylindrically-shaped housing means;

dual-actuating ram assembly means disposed concentrically within said outer housing member;

angled bracket means mounted hingedly on the peripheral surface of said outer housing means and including a punch bit positioned for outward radial movement;

said ram assembly means being formed of a cylinder and a piston rod; and said piston rod being moved in a reciprocal motion from a retracted position to a an extended position so as to cause said angled bracket means to pivot outwardly and said punch bits to move outward radially for punching holes in the clogged drain pipe sections.

13. A drain line re-perforator device as claimed in claim 12, wherein each of said angled bracket means is formed generally of a L-shaped configuration having a shorter leg portion, a longer leg portion, and an annular mounting portion for joining together said shorter leg portion and said longer leg portion.

14. A drain line re-perforator device as claimed in claim 13, wherein said outer housing means include three equally spaced-apart slots disposed around its circumference and adjacent its top end, said slots receiving therein a corresponding one of the annular mounting portions of the angled bracket means.

15. A drain line re-perforator device as claimed in claim 14, further comprising a pivot pin being inserted through each of said annular mounting portions for mounting pivotally each of said angled bracket means on the peripheral surface of said housing means.

16. A drain line re-perforator device as claimed in claim 12, further comprising a front end cap secured to the top end of said housing means and a rear end cap secured to the bottom end thereof for facilitating the sliding of the re-perforator device into and out of the clogged drain pipe sections.

17. A drain line re-perforator device as claimed in claim 16, further comprising a hinged portion secured to said rear end cap for connection to a rodder to facilitate the easy pushing of the re-perforator device down the clogged drain pipe sections.

18. A drain line re-perforator device as claimed in claim 12, wherein said ram assembly means is operated pneumatically with an air pressure in the range of 100 p.s.i. to 120 p.s.i.

* * * * *